US006153347A

United States Patent [19]

Kabai et al.

[11] Patent Number: 6,153,347

[45] Date of Patent: Nov. 28, 2000

[54] DEVELOPING AGENT AND METHOD OF MANUFACTURING THE SAME

[75] Inventors: Takahito Kabai; Yuuko Takano; Yasuo Goto, all of Yokohama; Toshiaki Yamauchi, Fujisawa; Yukihiro Fujikura, Kawasaki; Hisanobu Ajima, Kawasaki; Yoshihito Shimada, Kawasaki; Hiroshi Ohno, Yokohama, all of Japan

[73] Assignees: Toshiba TEC Kabushiki Kaisha, Tokyo; Kabushiki Kaisha Toshiba, Kawasaki-shi, both of Japan

[21] Appl. No.: 09/290,609

[22] Filed: Apr. 13, 1999

[30] Foreign Application Priority Data

Apr. 13, 1998 [JP] Japan ..... 10-101100

[51] Int. Cl.[7] ..... G03G 9/097

[52] U.S. Cl. ..... 430/110; 430/137

[58] Field of Search ..... 430/137, 110, 430/111, 109

[56] References Cited

U.S. PATENT DOCUMENTS

| | | | |
|---|---|---|---|
| 5,863,694 | 1/1999 | Sano et al. | 430/137 |
| 5,935,751 | 8/1999 | Matsuoka et al. | 430/137 |
| 5,989,770 | 11/1999 | Ugai et al. | 430/137 |

FOREIGN PATENT DOCUMENTS

| | | |
|---|---|---|
| 3-36426 | 5/1991 | Japan . |
| 8-16789 | 2/1996 | Japan . |

*Primary Examiner*—John Goodrow
*Attorney, Agent, or Firm*—Foley & Lardner

[57] ABSTRACT

A wax dispersion in a developing agent using a polyester resin is improved by adding an ester wax in the polyester polymerizing step or both in the polymerizing and kneading steps, or by adding a compatibilizing agent selected from the group consisting of alkylene block copolymer or graft copolymer to a polyester-styrene hybrid resin used in place of the polyester resin.

16 Claims, 4 Drawing Sheets

DEVELOPING AGENT AND METHOD OF MANUFACTURING THE SAME

BACKGROUND OF THE INVENTION

The present invention relates to a developing agent used in an image forming apparatus employing an electrophotographic system and a method of manufacturing the same.

In a full color electrophotographic process, the color reproduction is performed by superposition of four colors of cyan, magenta, yellow and black. Thus, it is necessary to use a toner having a high transparency and capable of providing a uniform fixed surface low in roughness. In order to obtain such a toner, required is a resin which can be sharp-melted i.e. it can be melted rapidly within the narrow range of temperature, and has a low molecular weight and a narrow molecular weight distribution. In general, a polyester series resin, which has a relatively high toughness even if the resin has a low molecular weight, is used as such a resin. However, the elasticity of the polyester series resin is lowered when the resin is melted, giving rise to a problem that an offset is likely to be generated.

As a measure against the offset problem, a fixing apparatus provided with an oil supply mechanism for coating a fixing roller with a silicone oil is used in general in the full color electrophotographic apparatus. However, if the particular fixing apparatus is used, the silicone oil is attached to the fixed print. Particularly, when an image is fixed to an OHP sheet, the silicone oil causes problems that a stripe pattern is formed on the fixed image and that the print is rendered sticky during storage.

It should also be noted that it is unavoidable for the fixing apparatus including the oil supply mechanism to be made bulky. Further, it is necessary to supply a silicone oil to the tank periodically. In addition, wear of the heat roller is generated by the mechanical stress of the oil supply mechanism, leading to a short life of the heat roller.

As a measure against the wear of the heat roller, it is possible to coat the surface of the heat roller with a fluorine-containing resin so as to increase the mechanical strength of the roller. However, the fluorine-containing resin is poor in its affinity with the silicone oil, with the result that, if the heat roller is coated with a fluorine-containing resin, it is impossible to coat the fixing roller with a sufficiently large amount of the oil. It follows that it is difficult to prevent the offset problem.

As another measure against the offset problem, a black toner is generally allowed to contain waxes such as polypropylene or polyethylene having a low molecular weight so as to impart release properties to the toner itself. However, the polyester series resin used in the full color toner is poor in compatibility with a wax having many nonpolar groups, compared with a styrene series resin widely used in a black toner. Also, the polyester series resin is thermally soft and, thus, a sufficient torque is unlikely to be applied to the resin if the resin is added in the kneading step. It follows that it is difficult to disperse finely the polyester series resin. It should be noted in this connection that the toner material is finely pulverized to a level of about 5 to 15 $\mu$m after the kneading step, making it necessary for the wax used to be dispersed finely within the toner. Where the wax dispersion is insufficient, the wax is exposed to the toner surface in a large amount so as to increase the so-called "spent toner", i.e., the phenomenon that the wax is agglomerated if the toner is left to stand under high temperatures or that the carrier is contaminated by the toner with time. The insufficient dispersion of the wax impairs the transparency of the toner or causes the filming on the photoreceptor. It is known to the art that a wax of polypropylene or polyethylene is added in the step of polymerizing styrene-acrylic series rein so as to improve the wax dispersion. However, the polyester series resin is poor in compatibility with such a wax, resulting in failure to improve the wax dispersion sufficiently.

In general, different kinds of polymers are poor in compatibility with each other, making it difficult to disperse finely these polymers. It is conceivable to introduce different kinds of polymers into a single molecular chain as in graft copolymerization or block copolymerization such that blocks of both polymers are branched or positioned alternately so as to permit the properties of both polymers to be present in the resultant copolymer and to further modify the copolymer. In this method, however, the wax is taken into the resin chain so as to weaken the function of the wax as an external lubricant to prevent the offset problem. Also, it is difficult to design and mix the wax freely.

BRIEF SUMMARY OF THE INVENTION

A polyester series resin has a low molecular weight, has a narrow molecular weight distribution, and tends to be sharp-melted. Therefore, if the resin is used in the manufacture of a developing agent, a high transparency is imparted to the manufactured developing agent. Also, the manufactured developing agent makes it possible to obtain a uniform fixed surface low in roughness.

However, the elasticity of the polyester series resin is lowered when melted and, thus, the resin is poor in resistance to the offset problem. Also, wax fails to be dispersed sufficiently in the polyester series resin. As a result of an extensive research, the resistance to the offset problem has been improved to some extent. However, other properties of the developing agent are impaired.

The present invention, which has been achieved in view of the situation described above, its object is intended to provide a developing agent using a polyester series resin as a binder resin, which permits improving its resistance to offset problem without being accompanied by inconveniences such as enlargement of the image forming apparatus, wear of the fixing member, and spent toner phenomenon and without impairing the characteristics such as the fluidity, storage properties, image quality, resistance to filming and transparency of the resin. Particularly, the present invention is intended to improve the dispersion of the wax into the polyester series resin used as a binder resin.

Another object of the present invention is to provide a method of manufacturing a developing agent exhibiting an improved resistance to the offset problem, particularly, to a method of manufacturing a developing agent in which a wax is sufficiently dispersed in a polyester series resin used as a binder resin.

According to a first aspect of the present invention, there is provided a developing agent comprising a binder resin and a coloring material, the binder resin containing a wax-added polyester resin prepared by adding an ester wax in the polymerizing step.

According to a second aspect of the present invention, there is provided a developing agent which is obtained by melting and kneading a mixture consisting of a coloring material, a binder resin containing a wax-added polyester resin prepared by adding an ester wax in the polymerizing step, and an ester wax.

According to a third aspect of the present invention, there is provided a developing agent comprising a polyester/ styrene hybrid resin, at least one of an alkylene block copolymer and graft copolymer, and a wax.

According to a fourth aspect of the present invention, there is provided a method of manufacturing a developing agent, comprising the step of preparing a wax-added binder resin by polymerizing a mixture obtained by adding an ester wax to a polyester raw material, and the step of melting and kneading a mixture consisting of the resultant binder resin and a coloring material to obtain a molten kneaded mixture.

According to a fifth aspect of the present invention, there is provided a method of manufacturing a developing agent, comprising the step of preparing a wax-added binder resin by polymerizing a mixture obtained by adding an ester wax to a polyester raw material, and the step of melting and kneading a mixture consisting of the resultant wax-added binder resin, an ester wax and a coloring material to obtain a molten kneaded mixture.

According to a sixth aspect of the present invention, there is provided a method of manufacturing a developing agent, comprising the step of preparing a binder resin by polymerizing a polyester/styrene hybrid resin raw material, and the step of melting and kneading a mixture consisting of the resultant binder resin and a coloring material to obtain a molten and kneaded mixture, a wax and one material selected from the group consisting of alkylene block copolymer and graft copolymer being added in the step of preparing the binder resin or the step of melting and kneading the mixture.

In the present invention, the dispersion of the polyester series resin and the wax within the developing agent is markedly improved so as to improve the resistance to the offset problem without impairing the characteristics such as the fluidity, storage properties, image quality, resistance to filming and transparency of the resin.

Also, the developing agent of the present invention makes it possible to omit a silicone oil coating mechanism mounted to a fixing device of a full color image forming apparatus or to lower the coating amount of the silicone oil. It follows that it is possible to prevent various difficulties such as enlargement of the apparatus, and stickiness and deterioration of the fixed image caused by an excessive silicone oil.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
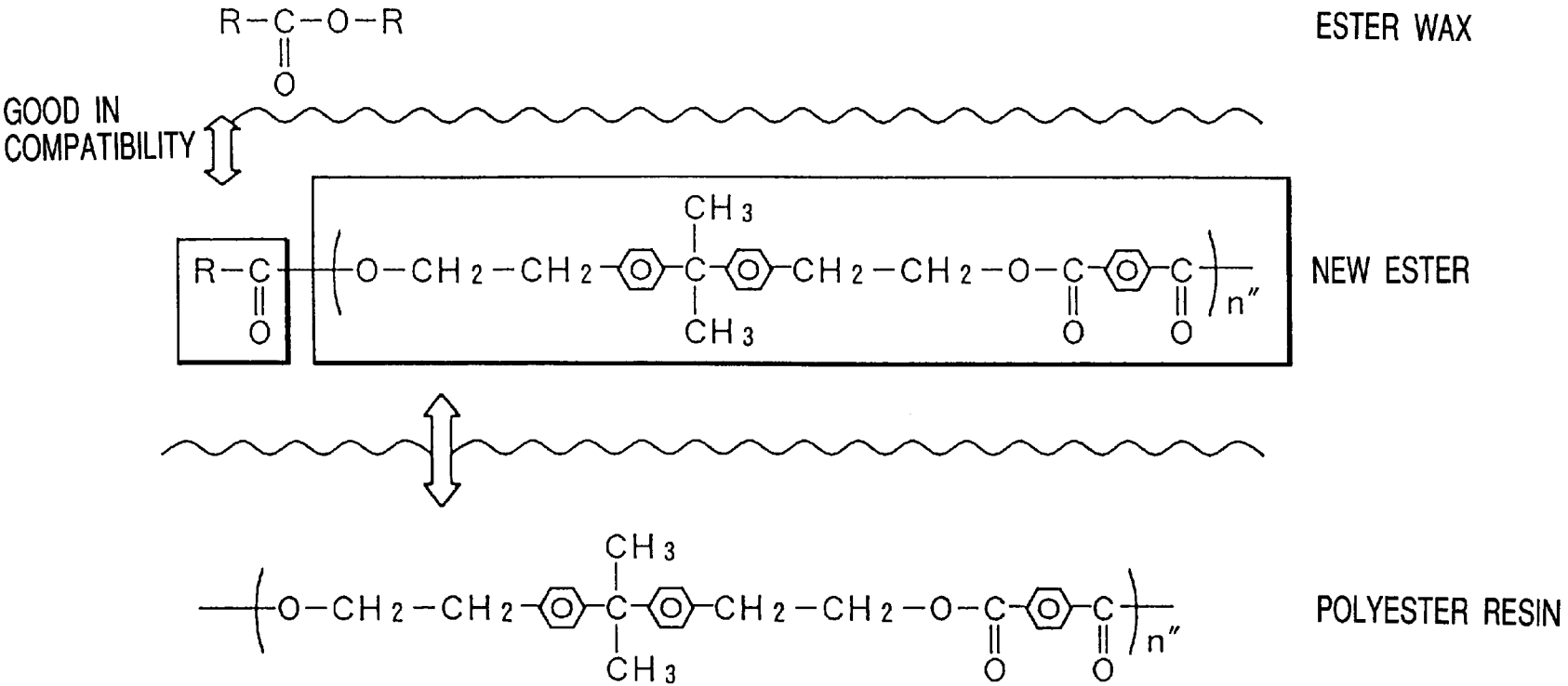
FIG. 1 shows as models a polyester, a wax and a new ester.

The present inventors have conducted an extensive research in an attempt to improve the dispersion of a polyester series resin used as a binder resin and a wax, and have found that it is possible to markedly improve the dispersion capability of the polyester series resin and the wax by using a predetermined wax or a compatibilizing agent so as to arrive at the present invention.

The present invention can be roughly classified into six aspects. The first to third aspects of the present invention are directed to a developing agent. On the other hand, the fourth to sixth aspects are directed to a method of manufacturing the developing agents defined in the first to third aspects.

The present invention is directed basically to a developing agent comprising a coloring material, a polyester series resin and a wax.

The first and fourth aspects of the present invention are featured mainly in that an ester wax used as a wax is added in the step of polymerizing a polyester resin. On the other hand, the second and fourth aspects of the present invention are directed to preferred embodiments of the first and fourth aspects, and are mainly featured in that an ester wax used as a wax is added in each of the polymerizing step and the melting-kneading step.

Further, the third and sixth aspects of the present invention are featured mainly in that a polyester/styrene hybrid resin used as a polyester series resin is mixed with a wax, and at least one of an alkylene block copolymer and graft copolymer is added as a compatibilizing agent to the mixture.

Let us describe more in detail the first to sixth aspects of the present invention.

Let us describe first a developing agent according to the first aspect of the present invention and a method of manufacturing a developing agent according to the fourth aspect of the present invention.

The developing agent of the first aspect comprises a binder resin containing a wax-added polyester resin prepared by adding an ester wax in the polymerizing step and a coloring material.

The method of manufacturing the developing agent according to the fourth aspect is directed to the manufacture of the developing agent of the first aspect, and comprises the step of preparing a wax-added binder resin by polymerization using a polyester material and an ester wax, the step of melting and kneading a mixture containing the resultant binder resin and a coloring material to obtain a molten and kneaded mixture, and the step of pulverizing the resultant molten and kneaded mixture to obtain toner particles.

In the present invention, the ester wax plays an important role for improving the compatibility between the resin and the ester wax.

The ester wax is represented by general formula (1):

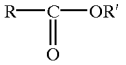

(1)

If energy is applied to the ester wax during polymerization of a polyester raw material having the ester wax added thereto, the ester wax represented by general formula (1) is partially decomposed into a free higher fatty acid represented by general formula (2):

R—COOH (2)

and a free higher alcohol represented by general formula (3):

HO—R' (3)

If the ester wax is added during polymerization of polyester in the present invention, the terminal OH group of the polycondensed polyester and the COOH group of the wax are considered to be condensed to introduce a linear alkyl group into the terminal.

The typical condensation reaction of polyester is shown in formula (4):

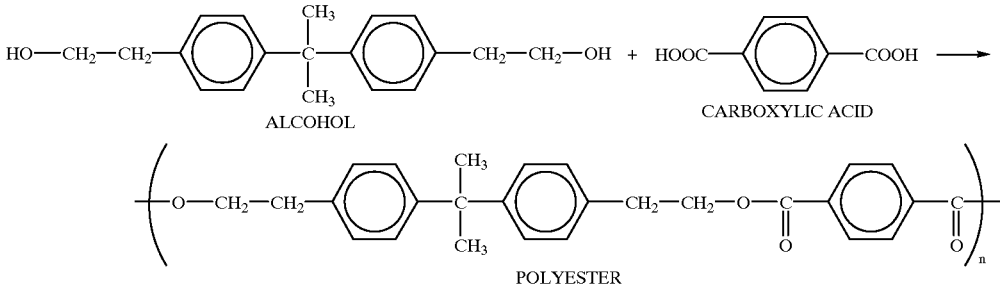

The introduction of a linear alkyl group by the free fatty acid is shown in formula (5):

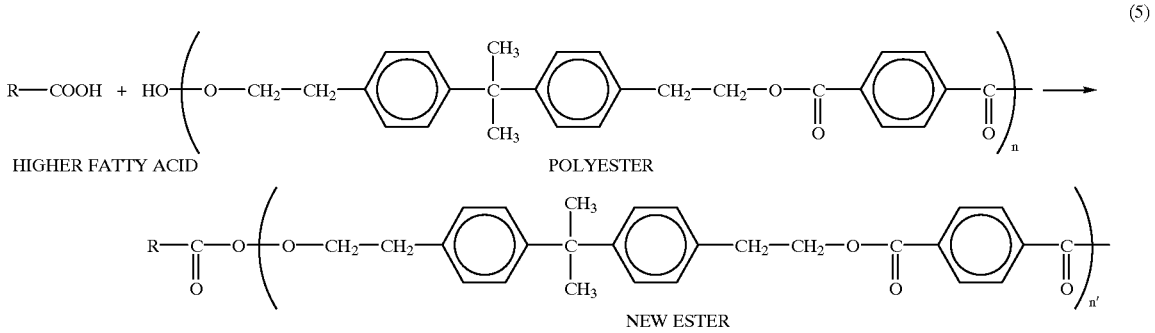

A new ester having a relatively low molecular weight, in which the ester of the wax is coordinated at the terminal of the polyester, is formed in this fashion.

FIG. 1 shows as a model how a new ester having a long chain alkyl group introduced therein enters the interface between the polyester and the wax.

As shown in the drawing, if the new ester having the long chain alkyl introduced therein enters the interface between the polyester resin and the wax, the polyester chain and the linear alkyl group of the new ester are considered to be well compatible with the polyester resin and the wax, respectively. In other words, the new ester acts as a compatibilizing agent.

The natural ester wax contains a free fatty acid and free alcohol derived from the unreacted higher fatty acid and higher alcohol. These free fatty acid and free alcohol relate to an acid value and an acetyl value, respectively. It is possible for these free fatty acid and free alcohol to be contained in a synthetic wax depending on the manufacturing conditions, etc.

Where a wax is added in synthesizing polyester, it is desirable to select a wax which does not contain large amounts of the free fatty acid (acid value) and free alcohol (acetyl value). If the free fatty acid (acid value) and free alcohol (acetyl value) are contained in excessively large amounts, the reaction tends to proceed excessively in the polymerizing step so as to markedly change the characteristics of the wax. A preferred acid value of the ester wax is 10 or less. It is desirable to use, for example, a rice wax having an acid value of about 5 and having an acetyl value of about zero.

The ester waxes used preferably in the present invention include, for example, natural ester waxes such as rice wax, carnauba wax, candellira wax, crude Japan wax, beeswax, lanolin, and montan wax. These waxes consist essentially of esters between higher fatty acids and higher aliphatic alcohols and contain other components such as unreacted higher fatty acids and higher alcohols. Synthetic waxes such as glycerin fatty acid ester and glycol fatty acid ester can also be used in the present invention in addition to the natural waxes noted above.

The natural waxes have a low melting point. For example, the rice wax has a melting point of about 79° C. On the other hand, the carnauba wax and candellila wax have melting points of about 83° C. and about 71° C., respectively. The natural waxes also have a low melt viscosity at 100° C. so as to be rapidly fused by a heat roller and, thus, to improve the resistance to the offset problem. However, the melting point tends to be unduly low. Also, if the natural wax exhibits an endothermic properties at DSC under low temperatures, the heat storage properties of the toner tend to be made poor. Under the circumstances, the rice wax and carnauba wax are used as excellent natural waxes in the present invention. Particularly, the rice wax is the most excellent natural wax in view of the resistance to the offset problem.

When it comes to the rice wax, lignoceric acid, which is a substantially linear saturated fatty acid having 24 carbon atoms, and behenic acid having 24 carbon atoms constitute a major portion of the higher fatty acids constituting the acid component of the ester, and higher alcohols having even number of carbon atoms falling within a range of between 24 and 34 carbon atoms constitute a major portion of the alcohol component of the ester. The rice wax, in which the number of carbon atoms falls within a relatively narrow range, having a high crystallinity is considered to contribute to the improvement in the resistance to the offset problem and to the improvement in luster. Particularly, it has been confirmed that the rice wax refined to permit lignoceric acid having 24 carbon atoms to constitute at least 60% of all the fatty acids contained in the wax permits further improving the resistance to the offset problem.

The amount of the wax added falls within a range of between 1 and 15% by weight, preferably, between 2 and 10% by weight. If the wax amount is smaller than the lower limit noted above, the developing agent fails to perform a sufficient function of preventing the offset problem. If the wax amount is unduly large, however, the heat storage characteristics of the toner are impaired and the wax fails to be dispersed sufficiently in the toner, leading to poor lifetime characteristics such as poor cleaning and low image concentration.

The chemical structure of the polyester resin used in the present invention is not particularly limited. It is possible to use an ordinary thermoplastic polyester. The polyester resin used in the present invention is a resin having as a backbone chain the polymer formed by ester condensation between a divalent acid and a divalent alcohol. Saturated or unsaturated monomers can be used for preparing the polyester resin used in the present invention. Where the polyester resin has an unsaturated double bond, copolymerization can be performed between the polyester resin and vinyl monomers such as styrene. However, it is undesirable for the crosslinking to proceed excessively to make the polyester resin thermosetting.

The divalent acids used as a monomer include, for example, phthalic acid, terephthalic acid, fumaric acid, maleic acid, sebacic acid, succinic acid and adipic acid. On the other hand, the divalent alcohols used include, for example, aliphatic glycols such as ethylene glycol, propylene glycol, butylene glycol and butenediol. More generally, ethylene oxide adducts or propylene oxide adducts of aromatic bisphenol A can be used as the divalent alcohol.

Let us describe the developing agent according to the second aspect of the present invention and the method of manufacturing the developing agent according to the fifth aspect of the present invention. These aspects represent preferred embodiments of the developing agent and the manufacturing method thereof according to the first and fourth aspects of the present invention.

The developing agent of the second aspect is obtained by melting and kneading a mixture containing a coloring material, a binder resin containing a wax-added polyester resin prepared by adding an ester wax in the polymerizing step, and an ester wax.

The fifth aspect is directed to a method of manufacturing the developing agent of the second aspect, and comprises the step of preparing a wax-added binder resin by polymerization using a polyester raw material and an ester wax, the step of melting and kneading a mixture containing the resultant wax-added binder resin, an ester wax and a coloring material, and the step of pulverizing the molten and kneaded mixture to obtain toner particles.

Any of the ester waxes used in the first and fourth aspects of the present invention can be used in the method of the fifth aspect as far as the wax has an ester group. It is possible for the wax added in the polymerizing step to prepare the polyester and the wax kneaded in the melting and kneading step to be different from each other as far as the wax has an ester group. However, it is desirable to use the same wax in order to obtain a further improved wax dispersion.

The amount of the wax added in the polymerizing step to prepare the polyester may preferably fall within a range of between 0.1 and 10% by weight, more preferably, between 1 and 5% by weight. If the wax addition amount is smaller than 0.1% by weight, formation of the ester component acting as a compatibilizing agent may be insufficient, resulting in failure to disperse the wax finely. Also, where the wax addition amount is larger than 10% by weight, the ester component is formed excessively, leading to a low molecular weight of the resin and to a poor resistance to the offset problem.

The sum of the wax added in the polymerizing step to prepare the polyester and the wax kneaded in the resin in the melting-kneading step may preferably fall within a range of between 1 and 15% by weight, more preferably, between 2 and 10% by weight. If the sum of the wax addition amounts is smaller than 1% by weight, the developing agent tends to fail to perform a sufficient function of preventing the offset problem. If the sum of the wax addition amounts is unduly large, however, the heat storage characteristics of the toner tends to be impaired and the wax fails to be dispersed sufficiently in the toner, leading to poor lifetime characteristics such as poor cleaning and low image concentration.

The polyester resin used in each of the first and fourth aspects of the present invention can be used as the polyester resin in which the ester wax is dispersed.

If an ester wax is added in the polymerizing step to prepare the polyester, the terminal OH group of the polycondensed polyester is considered to be condensed with the COOH group of the free fatty acid of the wax as shown in formula (5) to have a linear alkyl group introduced into the terminal. As a result, the ester of the wax is coordinated at the terminal of the polyester so as to form a new ester having a relatively low molecular weight. The new ester is considered to enter the interface between the polyester resin and the wax to make the polyester chain and the linear alkyl group of the new ester well compatible with the polyester resin and the wax, respectively. Thus, the new ester is considered to act as a compatibilizing agent, making it possible to obtain a polyester resin in which the wax is dispersed very finely.

Figure 2:
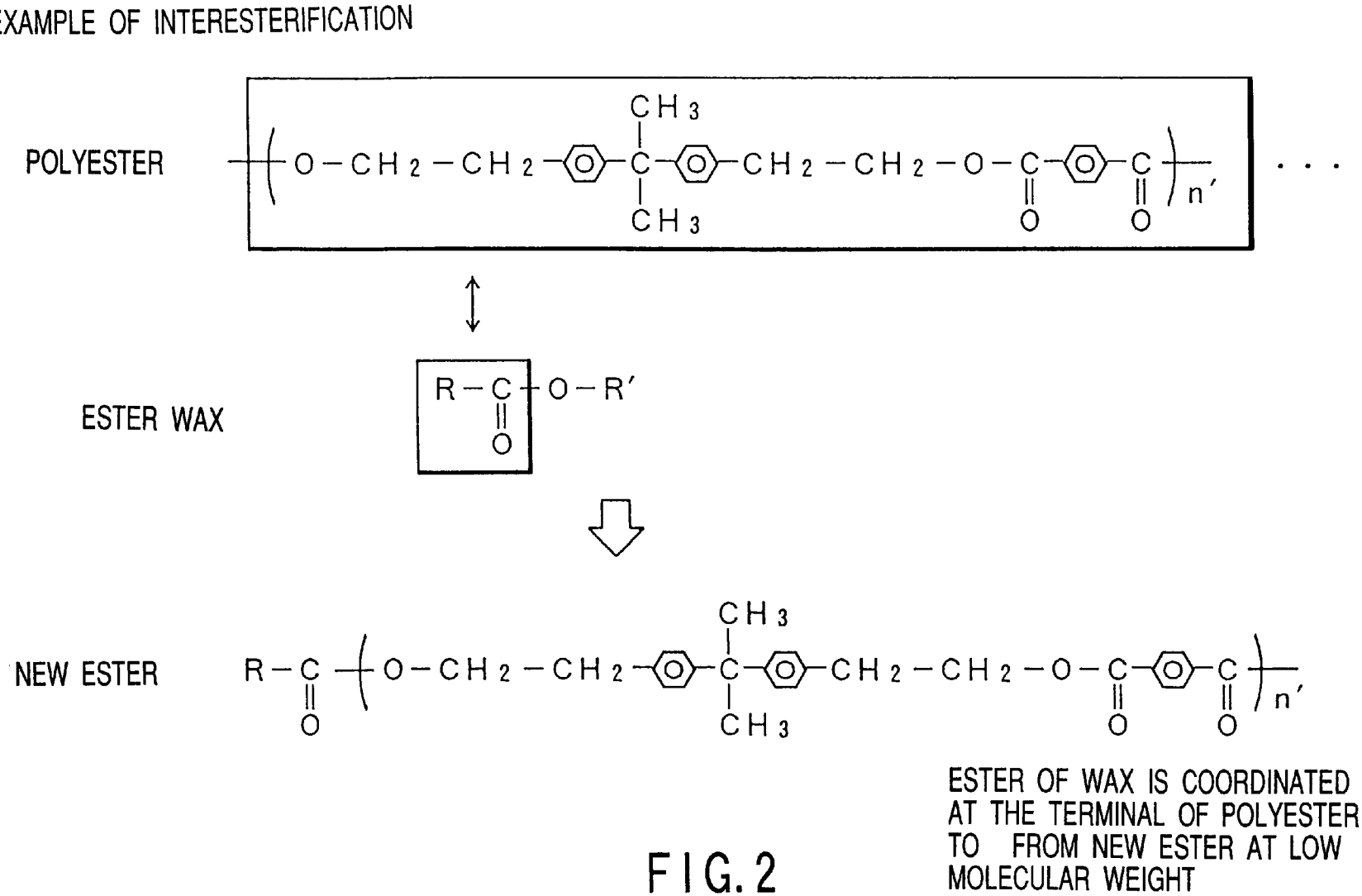
FIG. 2 shows the interesterification in the melting-kneading step.
Figure 3:
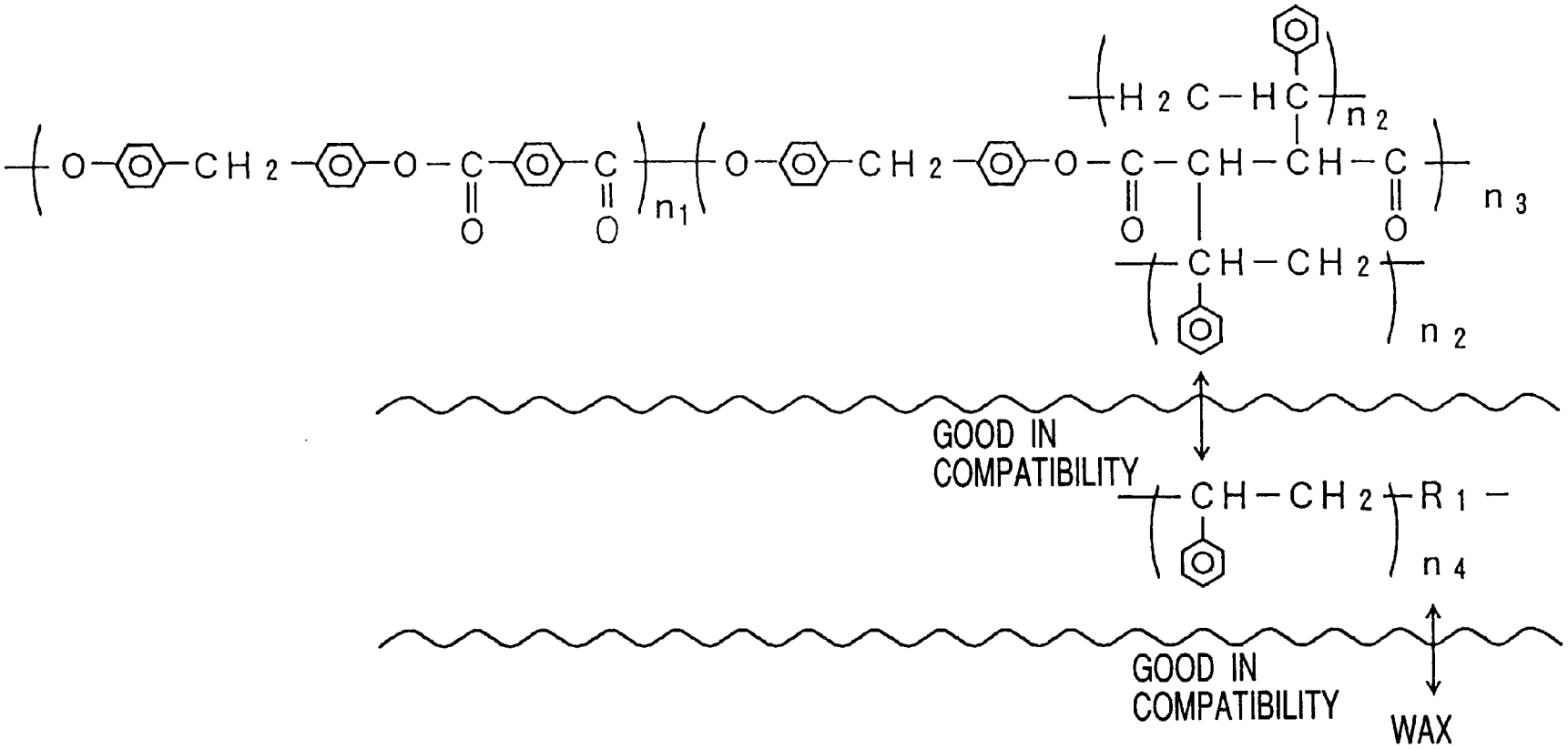
FIG. 3 shows the function of a compatibilizing agent acting on a hybrid resin of polyester and styrene and on a styrene/alkylene block copolymer.

Further, in the step of melting and kneading a mixture containing the polyester resin, a coloring material, CCA, etc., an additional wax is added to the mixture in a suitable amount. As a result, said additional wax is dispersed, and the wax added in the resin synthesizing step provides the nucleus. It follows that a highly satisfactory wax dispersion can be obtained, compared with the case where the wax is added only in the kneading step. It should also be noted that an interesterification is performed in this step between some ester groups of the polyester resin and some ester groups of the additional wax. FIG. 2 shows how the interesterification is performed. As shown in the drawing, a new ester having a molecular weight higher than that of the new ester described previously is considered to be formed by the interesterification.

Let us describe a developing agent according to the third aspect of the present invention and a method of manufacturing a developing agent according to the sixth aspect of the present invention.

It is known to the art that, even where two kinds of polymers A and B are blended in the kneading step under heat, the dispersion can be improved by adding a compatibilizing agent having an affinity with both of these polymers. It is effective to use as a compatibilizing agent a block copolymer and a graft copolymer each comprising polymers A and B as shown in chemical formulas (6) and (7).

(6)

$$(A)\!\!\!

agent is improved, the resistance to the offset problem is markedly improved. As a result, it is possible to use a heat roller having a silicone oil coating mechanism and a fluorine-containing resin coating omitted therefrom such as a silicone rubber roller or a roller coated with a fluoroplastic resin. Also, even where, for example, a silicone oil coating mechanism is used, the coating amount can be markedly decreased. For example, in the case of fixing a color toner, an oil is supplied to the heat roller in an amount of about 10 to 100 mg/sheet (sized A4). In the present invention, however, a satisfactory fixing can be performed by supplying an oil in an amount of about 4 mg/sheet (sized A4) or less. It follows that it is possible to suppress markedly the adhesion of the silicone oil to the printed sheet, the generation of a stripe pattern on the image on, particularly, an OHP sheet, and the stickiness during the storage.

The method of preparing the toner having a wax dispersed therein is not particularly limited in the present invention. In general, the toner can be prepared by uniformly blending and kneading a mixture containing a binder resin, a coloring material, a charge controlling agent, etc., followed by pulverizing the kneaded mixture to a desired fineness and classifying the pulverized mixture and subsequently adding additives such as silica and titanium oxide to the classified mixture. Also, the machines used for preparation of the developing agent are not particularly limited.

Let us describe the present invention more in detail with reference to Examples.

Figure 4:
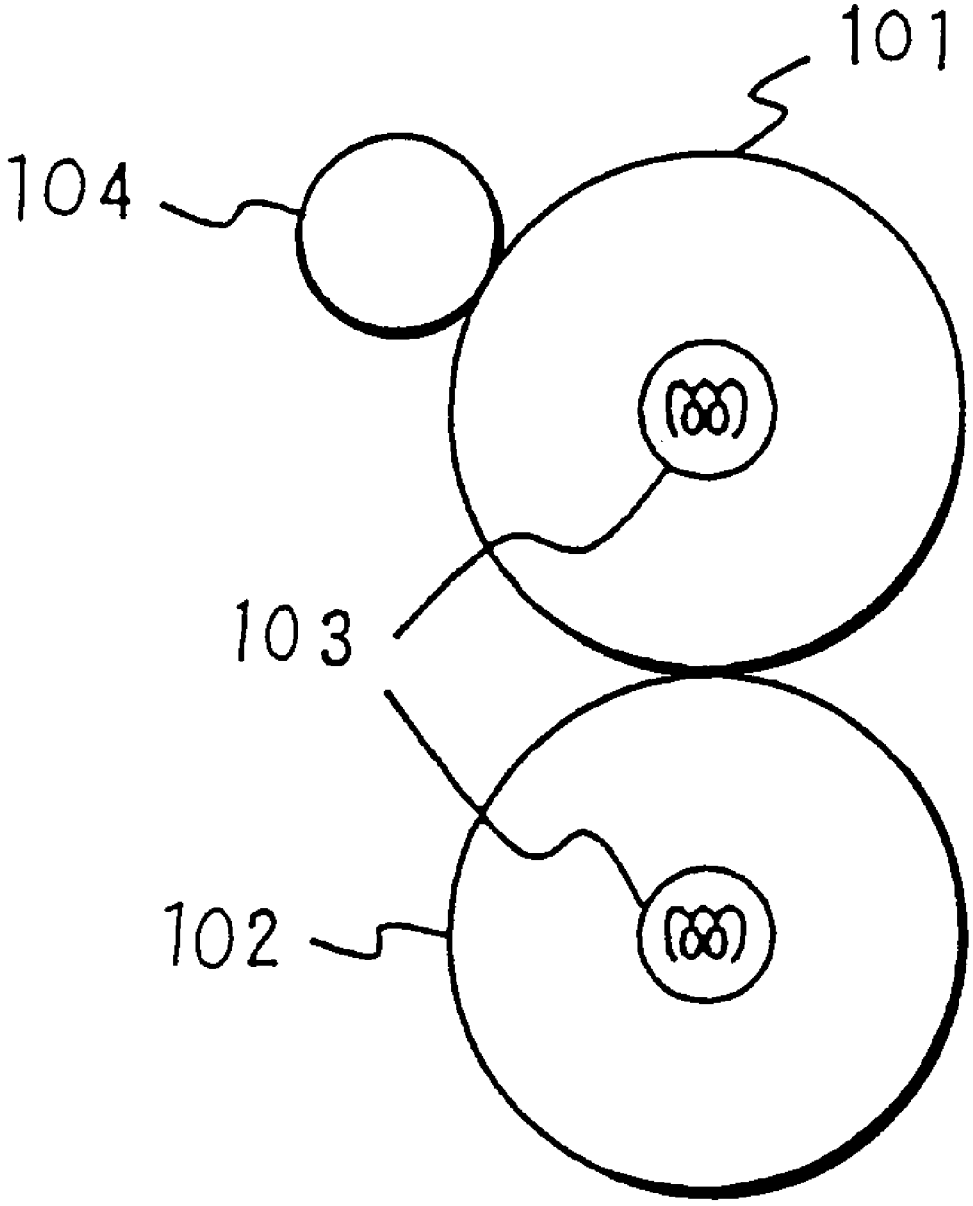
FIG. 4 schematically shows a fixing device used for evaluating the characteristics of the toner of the present invention.

Used in the Examples is an apparatus prepared by modifying a fixing apparatus of "Premarju 251", which is a trade name of an electronic copying machine manufactured by Toshiba Corporation, Japan, in order to evaluate the fixation, offset resistance, picture image, life characteristics, etc. of the toner. FIG. 4 shows the fixing apparatus used for evaluating the properties of the toner.

As shown in the drawing, the fixing apparatus comprises a heat roller 101, a cleaning roller 104 arranged in contact with the heat roller 101, and a pressurizing roller 102 which can be rotated in synchronism with the heat roller 101. The heat roller 101 comprises a core having a heater 103 housed therein, a rubber layer covering the core and a thin tube of PFA, PTFE, etc. covering the rubber layer. The heater 103 is also arranged within the pressurizing roller 102. It is possible to have the cleaning roller 104, which serves to remove traces of toner, paper dust, etc., impregnated with a silicone oil.

In the experiment conducted this time for testing the offset resistance, the roller was not impregnated at all with a silicone oil. Also, a PFA tube roller having a diameter of 40 mm was used as each of the heat roller 101 and the pressurizing roller 102, and the experiment was conducted under the conditions that the roller hardness was 70°, the nip width was 6 mm, the load was 55 kgf, and the process speed was 127 mm/sec.

Let us describe Examples according to the first and fourth aspects of the present invention.

EXAMPLE 1

In synthesizing a polyester resin, used as an alcohol component was 65.034 parts by weight of propylene oxide of bisphenol A or ethylene oxide adduct, e.g., polyoxypropylene (2,2)-2,2-bis (4-hydroxyphenyl) propane. Also used as acid components were 15.162 parts by weight of terephthalic acid and 10.596 parts by weight of fumaric acid. Further, 5.208 parts by weight of rice wax having a melting point of 79° C. and an acid value of 4.7 was added so as to carry out polymerization such that the amount of the rice wax was 5% by weight based on the total resin amount after the polymerization.

The resultant wax-added polyester resin had a Tg of 65° C., a weight average molecular weight of 13,000 and a number average molecular weight of 3,000. Also, the transparency of the polyester resin was maintained, though the resin was colored by the wax.

Then, 96 parts by weight of the resultant resin, 3 parts by weight of an azo-series magenta pigment and 1 part by weight of a colorless metal complex CCA were uniformly mixed and kneaded by a pressurizing kneader at about 80° C., followed by pulverizing the resultant mixture by a hammer mill into a powder passing through 2 mm meshes. Further, the powder was finely pulverized by a jet pulverizer, followed by removing fine powder by a gas stream classifying machine so as to obtain magenta toner particles having a particle diameter of 8.0 $\mu$m in 50% by volume of the toner particles.

Further, 100 parts by weight of the toner particles and 1 part by weight of a hydrophobic silica RX 200 (trade name of a silica fine powder manufactured by Japan Aerosil K.K.) were mixed for 3 minutes by a Henschel mixer, followed by passing the mixture through a sieve of 200 meshes so as to obtain a desired two-component negatively charged toner.

The resultant toner was put in Premarju 251 referred to previously for an image formation. A clear magenta image was obtained. Also, fogging and toner scattering did not take place. Further, the formed image and the developing agent were tested to evaluate the non-offset temperature, OHP transmittance, heat storage properties, life image density, and filming of the photoreceptor, with the results as shown in Table 1.

For measuring the life image density, an image was printed on 60,000 sheets of paper, and the image density (ID) of the final printed sheet was measured by a Macbeth densitometer. In Table 1, the result of the measurement is given by marks "○", "Δ" and "X", which are defined as follows:

○: ID (image density) of at least 1.8;

Δ: ID not lower than 1.7 and lower than 1.8;

X: ID lower than 1.7.

The filming of the photoreceptor was visually measured, and the result of the measurement is given by marks "○", "Δ" and "X", which are defined as follows:

○: No filming;

Δ: Filming was observed, but the image was not affected by the filming;

X: Dotted stains were formed on the image.

The non-offset region was evaluated by visually observing the image by using the fixing apparatus shown in FIG. 4. The non-offset region was found to be 140 to 180° C., as shown in Table 1.

For measuring the toner transmittance, an image was fixed to an OHP sheet at 160° C. by using the fixing apparatus shown in FIG. 4. The transmittance of light having a wavelength of 690 nm was measured by using a spectrometer. The transmittance was found to be 75%, supporting a good transparency.

For measuring the heat storage characteristics, the obtained toner was put in a polyethylene container, and the container was kept put for 8 hours in a constant temperature bath set at 55° C. The heat storage characteristics were evaluated by visually observing the agglomeration of the toner after the container containing the toner was taken out of the constant temperature bath. The result of the measurement is given by marks "○", "Δ" and "X", which are defined as follows:

○: The toner remained to be powdery;

Δ: The toner was brought back to the powdery state by vibration;

X: The toner was solidified.

Agglomeration of the toner was scarcely observed, indicating that the heat storage characteristics were satisfactory.

Comparative Example 1

A polyester resin was synthesized as in Example 1, except that wax was not added to the raw materials of the resin. Then, toner was prepared by using the resultant resin as in Example 1. Also, a fixing test was conducted as in Example 1 for evaluating the characteristics of the toner. Table 1 also shows the results.

In the fixing test, offset was generated at any of the temperatures at which the fixing test was conducted, with the result that the paper sheet was found to be attached to the heat roller. On the other hand, the heat storage characteristics were found to be satisfactory.

Comparative Example 2

A polyester resin was synthesized as in Example 1 except that wax was not used for the synthesis of the resin. Then, toner was prepared as in Example 1 by uniformly mixing 91 parts by weight of the resultant polyester resin, 5 parts by weight of rice wax, 3 parts by weight of an azo-series magenta pigment, and 1 part by weight of a colorless metal complex CCA. A fixing test was conducted as in Example 1 by using the resultant toner so as to evaluate the characteristics of the toner. Table 1 also shows the results.

The resultant toner was put in Premarju 251 referred to previously so as to evaluate the image formed on a copying paper sheet. The clearness of the image was found to be somewhat inferior. Further, the image was copied on additional 30,000 copying paper sheets, with the results that the image density was lowered, and filming was found on the photoreceptor.

Further, a fixing test was conducted by using the fixing apparatus shown in FIG. 4, with the result that the non-offset region was obtained at temperatures of 140 to 180° C. Also, the transmittance at the OHP fixing at 160° C. was found to be 71%. Concerning the heat storage characteristics, agglomeration was slightly observed.

EXAMPLE 2

A polyester resin was prepared as in Example 1, except that 5% by weight of Carnauba Wax No. 1, which is a trade name of wax manufactured by N.S. Chemical K.K., said wax having a melting point of 83° C. and an acid value of 3, was used as the wax. Then, toner was prepared as in Example 1. A fixing test was applied to the resultant toner as in Example 1 so as to evaluate the characteristics of the toner. The results of the fixing test are also shown in Table 1.

The resultant toner was put in a digital copying machine Premarju referred to previously for evaluating the copied image. It was possible to obtain a clear magenta image. Further, a copied image satisfactory in both image density and fogging was obtained even after copying on 60,000 paper sheets as in Example 1. In addition, scattering of toner was effectively prevented.

Further, a fixing test was conducted, with the result that it was possible to obtain an offset region at 150 to 170° C. The transmittance at an OHP fixing was found to be 73% at 160° C. Further, the heat storage characteristics were also found satisfactory.

Comparative Example 3

A polyester resin was prepared as in Example 1, except that 5% of "Mitsui Hiwax 800P" (trade name of a polyethylene wax having a melting point of 127° C., which is produced by Mitsui Chemical Co., Ltd., Japan,) was used as a wax. The synthesized resin was found to be blurred whitish. Then, a toner was prepared as in Example 1 by using the resultant toner.

A fixing test was conducted as in Example 1 by using the resultant toner so as to evaluate the characteristics of the toner. Table 1 shows the results.

A copied image was evaluated by putting the toner in a digital copying machine Premarju referred to previously, with the result that the copied image was somewhat inferior in clearness. Further, the copying was performed on additional 10,000 paper sheets, with the result that the image density was lowered, and filming was observed on the photoreceptor.

Further, a fixing test was conducted by using the fixing device shown in FIG. 4, with the result that a non-offset region was obtained at 160 to 180° C. Also, the transmittance in an OHP fixing at 160° C. was found to be 68%. Concerning the heat storage characteristics, powdery agglomerate was observed to some extent.

Comparative Example 4

A polyester resin was prepared as in Example 1, except that 5% of "Micro Wax 180" (trade name of wax having a melting point of 83° C., which is produced by Mobile Oil Co., Ltd., Japan) was used as a wax. The synthesized resin was found to be blurred whitish. Then, a toner was prepared as in Example 1 by using the resultant resin.

A fixing test was conducted as in Example 1 by using the resultant toner so as to evaluate the characteristics of the toner. Table 1 shows the results.

A copied image was evaluated by putting the toner in a digital copying machine Premarju referred to previously, with the result that the copied image was somewhat inferior in clearness. Further, the copying was performed on additional 10,000 paper sheets, with the result that the image density was lowered, and filming was observed on the photoreceptor.

Further, a fixing test was conducted by using the fixing device shown in FIG. 4, with the result that a non-offset region was obtained at 140 to 170° C. Also, the transmittance in an OHP fixing at 160° C. was found to be 70%. The heat storage characteristics were found to be poor because agglomerate powder was formed.

TABLE 1

| | Kind of wax | Non-offset temperature (° C.) | OHP transmittance (%) | Heat storage characteristics | Life ID | Filming on photoreceptor |
|---|---|---|---|---|---|---|
| Comparative Example 1 | None | xx (JAM) | — | ○ | — | — |
| Example 1 | Rice wax | 140 to 180 | 75 | ○ | ○ | ○ |
| Example 2 | Carnauba wax | 150 to 170 | 73 | ○ | ○ | ○ |
| Comparative Example 2 | Rice was added in kneading step | 140 to 180 | 71 | Δ | Δ | Δ |
| Comparative example 3 | Polyethylene wax | 150 to 180 | 68 | ○ | x | x |
| Comparative Example 4 | Micro wax | 140 to 170 | 70 | x | x | x |

As apparent from Examples 1 and 2 shown in Table 1, the developing agent of the present invention was found to exhibit satisfactory characteristics such as the non-offset temperature, OHP transmittance, life image density, and filming on the photoreceptor. However, satisfactory toner characteristics were not obtained in any of Comparative Example 1, in which wax was not added at all, Comparative Example 2, in which rice wax was not added in the polymerizing step, and Comparative Examples 3 and 4, in which other waxes were used.

Let us describe Examples directed to the second and fifth aspects of the present invention together with Comparative Examples.

EXAMPLE 3

A wax-added polyester resin was prepared as in Example 1. Then, a magenta toner 50% by volume of which had a particle diameter of 8 $\mu$m was prepared as in Example 1, except that 91 parts by weight of the resultant wax-added polyester resin, 3 parts by weight of azo-series magenta pigment, 1 part by weight of a colorless metal complex CCA, and 5 parts by weight of rice wax were uniformly mixed and, then, a desired two-component negatively charged toner was obtained by using the mixture.

An image was formed as in Example 1 by using the resultant toner. A highly clear magenta image was obtained.

Also, the formed image and the developing agent were evaluated in respect of the non-offset temperature, OHP transmittance, heat storage characteristics and filming on a photoreceptor, as in Example 1, so as to obtain satisfactory results.

Further, the carrier was separated from the developing agent after the printing test so as to measure the carbon amount, and the carbon amount thus measured was compared with the carbon amount in the initial carrier so as to determine the spent toner amount. The spent toner amount was found to be small.

Table 2 shows the experimental data.

Comparative Example 5

Toner was prepared as in Comparative Example 2, except that 86 parts by weight of a polyester resin, 10 parts by weight of rice wax, 3 parts by weight of azo-series magenta pigment and 1 part by weight of a colorless metal complex CCA were melted and kneaded, and that wax was not added in the polymerizing step to obtain resin.

An image was formed as in Example 3 by using the resultant toner. The image was found to be somewhat inferior in clearness. Also, the characteristics of the formed image and the developing agent were evaluated as in Example 3. Table 2 also shows the experimental data.

When an image was printed on 30,000 paper sheets, the image density was lowered, and a filming was found on the photoreceptor. Also, a large amount of the spent toner was found after the printing test, indicating that the developing agent was deteriorated. This is considered to have been caused by a poor dispersion of wax.

A fixing test was conducted, with the result that a non-offset region was obtained at 140 to 180° C. Also, the transmittance in a OHP fixing at 160° C. was found to be 71%. Concerning the heat storage characteristics, agglomerate powder was slightly observed.

Comparative Example 6

Toner was prepared as in Example 3, except that 5 parts by weight of polypropylene wax having a melting point of 150° C. was added in the polymerizing, melting and kneading step.

An image was formed as in Example 3 by using the resultant toner. The image was found to be somewhat inferior in clearness. Also, the characteristics of the formed image and the developing agent were evaluated as in Example 3. Table 2 also shows the experimental data.

When an image was printed on 10,000 paper sheets, the image density was slightly lowered, and a filming was found on the photoreceptor. Also, a large amount of the spent toner was found after the printing test, indicating that the developing agent was deteriorated. This is considered to have been caused by a poor dispersion of the polypropylene wax.

A fixing test was conducted by using the fixing apparatus shown in FIG. 4, with the result that a non-offset region was degraded to be 150 to 170° C. Also, the transmittance in a OHP fixing at 160° C. was found to be 68%. Concerning the heat storage characteristics, agglomerate powder was slightly observed.

EXAMPLE 4

Toner was prepared as in Example 1, except that a synthetic ester wax having a melting point of 72° C. was added in the polymerizing and melting-kneading steps.

An image was formed as in Example 3 by using the resultant toner. A clear magenta image was obtained. Also, the characteristics of the formed image and the developing agent were evaluated as in Example 3. Table 2 also shows the experimental data.

When an image was printed on 30,000 paper sheets, it was possible to obtain an image satisfactory in image density and fogging. Also, scattering of toner was not observed.

A fixing test was conducted by using the fixing apparatus shown in FIG. 4, with the result that a non-offset region was obtained at 140 to 180° C. Also, the transmittance in a OHP fixing at 160° C. was found to be 73%. Further, the heat storage characteristics were found to be satisfactory.

EXAMPLE 5

Toner was prepared as in Example 3, except that a synthetic ester wax having a melting point of 72° C. was added in the melting and kneading step. An image was formed as in Example 3 by using the resultant toner. A clear magenta image was obtained.

Also, the formed image was found satisfactory in both the image density and fogging even after printing on 30,000 paper sheets. The toner scattering was also satisfactory. Further, the characteristics of the formed image and the developing agent were evaluated as in Example 3. Table 2 also shows the experimental data.

A fixing test was conducted by using the fixing apparatus shown in FIG. 4, with the result that a non-offset region was obtained at 140 to 170° C. Also, the transmittance in an OHP fixing at 160° C. was found to be 74%. Further, the heat storage characteristics were found to be satisfactory.

removing fine powder by a gas stream classifying machine so as to obtain magenta toner particles having a particle diameter of 8.0 $\mu$m in 50% by volume of the toner particles.

Further, a desired two-component negatively charged toner was obtained as in Example 1 by using the resultant toner particles. An image formation was performed by using the toner thus obtained as in Example 1, with the result that a clear magenta image was obtained.

Still further, the formed image and the developing agent were tested to evaluate the non-offset temperature, OHP transmittance, heat storage characteristics, life image density and filming on the photoreceptor, as in Example 1, so as to obtain satisfactory results as shown in Table 3.

Also, the formed image was found satisfactory in both the image density and fogging even after printing on 60,000 paper sheets. Further, the toner was not scattered.

A fixing test was conducted by using the fixing apparatus shown in FIG. 4, with the result that a non-offset region was obtained at 140 to 180° C. Also, the transmittance in an OHP fixing at 160° C. was found to be 74%. Further, a polyethylene container containing the toner was kept put in a constant temperature bath set at 55° C. for 8 hours. Agglomeration of the toner was scarcely found. Also, the heat storage characteristics were found to be satisfactory.

TABLE 2

| | Added wax | | | | Heat | | | Filming |
|---|---|---|---|---|---|---|---|---|
| | During resin synthesis | During toner manufacture | Non-offset temperature (° C.) | OHP transmittance (%) | storage characteristics | Spent toner | Life ID | on photoreceptor |
| Example 3 | Rice wax 5% | Rice wax 5% | 140 to 180 | 76 | ○ | ○ | ○ | ○ |
| Comparative Example 5 | None | Rice wax 10% | 140 to 180 | 71 | Δ | x | x | x |
| Comparative Example 6 | PP wax 5% | PP wax 5% | 150 to 170 | 68 | Δ | x | x | x |
| Example 4 | Synthetic ester wax | Synthetic ester wax 5% | 140 to 180 | 73 | ○ | ○ | ○ | ○ |
| Example 5 | Rice wax 5% | Synthetic ester wax 5% | 140 to 170 | 74 | ○ | ○ | ○ | ○ |

As shown in Table 2, the developing agent in any of Examples 3 to 5 was satisfactory in any of the non-offset temperature, OHP transmittance, heat storage characteristics, life image density, spent toner amount and filming on the photoreceptor. However, satisfactory results were not obtained in Comparative Example 5, in which wax was not added in the polymerizing step, and Comparative Example 6, in which a wax other than an ester wax was used. Further, Example 3 was found to be more satisfactory than Example 1.

Let us describe Examples according to the third and sixth aspects of the present invention.

EXAMPLE 6

A mixture consisting of 86 parts by weight of a polyester/styrene hybrid resin, 5 parts by weight of a rice wax having a melting point of 79° C., 5 parts by weight of a styrene/ethylene block copolymer, 3 parts by weight of an azo-series magenta pigment, and 1 part by weight of a colorless metal complex CCA was uniformly blended, followed by kneading the mixture in a pressurizing kneader at about 80° C. The kneaded mixture was pulverized by a hammer mill into a powder passing through 2 mm meshes. Further, the powder was finely pulverized by a jet pulverizer, followed by

Comparative Example 7

Toner was prepared without adding a compatibilizing agent. Specifically, a magenta toner was prepared as in Example 6, except that a mixture consisting of 91 parts by weight of a polyester/styrene hybrid resin, 5 parts by weight of a rice wax having a melting point of 79° C., 3 parts by weight of an azo-series magenta pigment, and 1 part by weight of a colorless metal complex was uniformly blended, followed by kneading the mixture in a pressurizing kneader.

An image was formed by using the resultant toner as in Example 1. The formed image was found to be somewhat inferior in clearness. Also, the formed image and the developing agent were tested to evaluate the non-offset temperature, OHP transmittance, heat storage characteristics, life image density and filming on the photoreceptor, as in Example 1. The results are also shown in Table 3.

When printing was performed on 30,000 paper sheets, the image density was lowered. Also, filming was formed on the photoreceptor.

A fixing test was conducted by using the fixing apparatus shown in FIG. 4, with the result that a non-offset region was obtained at 140 to 180° C. Also, the transmittance in an OHP fixing at 160° C. was found to be 71%. Concerning the heat storage characteristics, agglomeration of the toner was found to some extent.

EXAMPLE 7

Toner was prepared as in Example 6, except that Micro Wax 180 (trade name of wax manufactured by Mobile Oil Co., Ltd.) having a melting point of 83° C. was used in place of the rice wax used in Example 6.

An image was formed by using the resultant toner as in Example 1. A clear magenta image was obtained. Also, the formed image and the developing agent were tested to evaluate the non-offset temperature, OHP transmittance, heat storage characteristics, life image density and filming on the photoreceptor, as in Example 1. The results are also shown in Table 3.

Also, the formed image was found satisfactory in both the image density and fogging even after printing on 60,000 paper sheets. Further, the toner was not scattered.

A fixing test was conducted by using the fixing apparatus shown in FIG. 4, with the result that a non-offset region was obtained at 140 to 170° C. Also, the transmittance in an OHP fixing at 160° C. was found to be 74%. The heat storage characteristics were also found satisfactory.

EXAMPLE 8

Toner was prepared as in Example 6, except that 5 parts by weight of a styrene/butadiene graft copolymer was used as a compatibilizing agent.

An image was formed by using the resultant toner as in Example 1. A clear magenta image was obtained. Also, the formed image and the developing agent were tested to evaluate the non-offset temperature, OHP transmittance, heat storage characteristics, life image density and filming on the photoreceptor, as in Example 1. The results are also shown in Table 3.

Also, the formed image was found satisfactory in both the image density and fogging even after printing on 60,000 paper sheets. Further, the toner was not scattered.

A fixing test was conducted by using the fixing apparatus shown in FIG. 4, with the result that a non-offset region was obtained at 140 to 170° C. Also, the transmittance in an OHP fixing at 160° C. was found to be 73%. The heat storage characteristics were also found satisfactory.

TABLE 3

| | Kind of wax/compatibilizing agent | Non-offset temperature (° C.) | OHP transmittance (%) | Heat storage characteristics | Life ID | Filming on photoreceptor |
|---|---|---|---|---|---|---|
| Example 6 | Rice wax/PS/PE | 140 to 180 | 74 | ○ | ○ | ○ |
| Comparative Example 7 | Rice wax/None | 150 to 170 | 71 | x | x | x |
| Example 7 | Rice wax/PS/PE | 140 to 170 | 74 | ○ | ○ | ○ |
| Example 8 | Rice wax/PS/Butadiene | 140 to 180 | 73 | ○ | ○ | ○ |

Additives Used Preferably in the Present Invention

It is possible to add transparent and substantially spherical fine particles finer than the toner particle to the developing agent of the present invention as additives. The additives may be required to have a glass transition point Tg of 100° C. or more and to produce a difference in charge amount of ±2 μC/g between the toner particles before mixing with the additives and the toner particles mixed with the additives. The additives can serve to suppress the spent toner without impairing the charging characteristics, making it possible to obtain toner stable in image density, capable of suppressing fogging and toner particle scattering, and having a long life.

When the developing agent is stirred, the temperature of the developing agent is elevated in the entire region or partially so as to deform the toner. If the toner is in contact at a distance of submicron order with the carrier over a large area, van der Waals force prevails so as to give rise to a strong toner adhesion, i.e., spent toner. The fine additive particles are intended to fill the role of rollers so as to prevent the toner from being mechanically fused to the carrier.

To achieve the object, the fine additive particles should desirably be shaped as close to spheres as possible. Also, for preventing the additive particles themselves from being deformed and deteriorated, the Tg of the additive particles should be 100° C. or more.

Alternatively, the additive particles are required not to have a glass transition point Tg at temperatures not lower than the thermal decomposition temperature.

It is important for the charging property of the additive particles to be basically equal to that of the toner particles. If the fine additive particles have a charge amount higher than that of the toner particles, the additive particles are moved away from the toner particles so as to charge strongly the carrier. As a result, the additive particles alone are accumulated so as to increase the charge amount of the developing agent and, thus, to lower the image density. By contraries, where the additive particles have a weak charging property or where the additives have the opposite polarity, the charging amount of the: toner is lowered so as to bring about a base fogging, leading to an increased toner scattering. In any case, these difficulties are rendered prominent with increase in the number of copied paper sheets so as to impair the life characteristics.

Incidentally, the Q/M value is increased with decrease in the particle size of the additives, making it difficult to compare the charging amounts of the additives themselves. However, the charging amount of the additive particles can be quantitatively determined by comparing the charging amount of the toner before addition of the additives with the charging amount of the toner after addition of the additives.

A blow-off method widely known in this technical field can be used for measuring the charging amount. For example, 0.2 g of a developing agent is put on a stainless steel mesh of 500 meshes, and the charging amount is measured under the condition that a $N_2$ gas is blown under a pressure of 0.5 kg/cm$^2$. The additives used in the present invention are required to have a difference in charging amount thus determined of ±2 μC/g, preferably ±1 μC/g, for suppressing the spent toner generation so as to obtain a toner having a long life.

The fine additive particles should desirably be sized smaller than the toner particles. Where the additives are used as a lubricant so as to decrease the spent toner, the particle size should desirably fall within a range of between 0.1 μm and 1 μm. The addition amount is generally about 0.1 to 5%. It is particularly effective to add the additive particles in an amount of 0.5 to 2%.

It is possible to use the fine additive particles in combination with known inorganic fine particles in order to improve the fluidity of the toner. The inorganic fine particles used in the present invention include fine particles of, for example, silicon dioxide, aluminum silicate, sodium silicate, zinc silicate, magnesium silicate, zinc oxide, titanium oxide, aluminum oxide, zirconium oxide, strontium titanate, and barium titanate. It is possible to apply a hydrophobic surface treatment to these inorganic fine particles with, for example, a silane coupling agent. These additives can be added to the toner by using, for example, a high speed flow type mixer.

The additives used in the present invention include transparent fine particles of, for example, polymethylmethacrylate, styrene-methylmethacrylate copolymer, silicone resin, crosslinked polystyrene, and polytetrafluoroethylene. In selecting the additives, it is important for the additives and the toner base body to have substantially the same charging property to the carrier.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent, obtained by melting and kneading a mixture containing a coloring material, an ester wax, and a binder resin, wherein said binder resin contains a wax-added polyester resin polymerized with an ester wax.

2. The developing agent according to claim 1, wherein said ester wax consists of a natural ester wax.

3. The developing agent according to claim 2, wherein said natural wax has an acid value of at most 10 and is selected from the group consisting of rice wax and carnauba wax.

4. The developing agent according to claim 1, wherein said ester wax is added in an amount of 1 to 15% by weight based on the total amount of the binder resin.

5. The developing agent according to claim 1, wherein the amount of said ester wax added in the polymerizing step is 0.1 to 10% by weight based on the total amount of the binder resin, and the sum of the ester wax added in the polymerizing step and in the melting-kneading step is 1 to 15% by weight based on the total amount of the binder resin.

6. A developing agent, comprising a polyester-styrene hybrid resin, a compatibilizing agent and a wax, said compatibilizing agent being selected from the group consisting of alkylene block copolymer and graft copolymer.

7. The developing agent according to claim 6, wherein said compatibilizing agent is added in an amount of 0.5 to 5.0% based on the amount of said polyester-styrene hybrid resin.

8. The developing agent according to claim 6, wherein said wax is selected from the group consisting of rice wax and carnauba wax.

9. A method for manufacturing a developing agent, comprising the steps of:

preparing a wax-added binder resin by polymerization using a polyester raw material and an ester wax; and melting and kneading a mixture containing the wax-added binder resin, an ester wax, and a coloring material to obtain a molten kneading mixture.

10. The method of manufacturing a developing agent according to claim 9, wherein said ester wax is a natural ester wax.

11. The method of manufacturing a developing agent according to claim 10, wherein said natural wax has an acid value of at most 10 and is selected from the group consisting of rice wax and carnauba wax.

12. The method of manufacturing a developing agent according to claim 9, wherein said ester wax is added in an amount of 1 to 15% by weight based on the total amount of the binder resin.

13. The method of manufacturing a developing agent according to claim 9, wherein the amount of said ester wax added in the polymerizing step is 0.1 to 10% by weight based on the total amount of the binder resin, and the sum of the ester wax added in the polymerizing step and in the melting-kneading step is 1 to 15% by weight based on the total amount of the binder resin.

14. A method of manufacturing a developing agent, comprising the steps of:

preparing a binder resin by polymerizing a polyester/styrene hybrid resin raw material; and melting and kneading a mixture containing of the resultant binder resin and a coloring material to obtain a molten and kneaded mixture;

wherein wax and a compatibilizing agent selected from the group consisting of alkylene block copolymer and graft copolymer are added in at least one of said polymerizing step and melting-kneading step.

15. The method of manufacturing a developing agent according to claim 14, wherein said compatibilizing agent is added in an amount of 0.5 to 5.0% by weight based on the amount of said polyester-styrene hybrid resin.

16. The method of manufacturing a developing agent according to claim 14, wherein said wax is selected from the group consisting of rice wax and carnauba wax.

* * * * *